US006302302B1

(12) United States Patent
Albisetti

(10) Patent No.: US 6,302,302 B1
(45) Date of Patent: Oct. 16, 2001

(54) LOCKABLE DISPENSING HEAD AND DISPENSER EQUIPPED THEREWITH

(75) Inventor: Nicolas Albisetti, Clichy (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/502,431

(22) Filed: Feb. 11, 2000

(30) Foreign Application Priority Data

Feb. 19, 1999 (FR) ..... 99 02112

(51) Int. Cl.[7] ..... B67B 5/00
(52) U.S. Cl. ..... 222/153.11; 222/182; 222/402.11
(58) Field of Search ..... 222/182, 402.11, 222/402.13, 153.11

(56) References Cited

U.S. PATENT DOCUMENTS

| | | | | |
|---|---|---|---|---|
| 2,887,273 | * | 5/1959 | Anderson | 239/337 |
| 3,721,423 | * | 3/1973 | Shay | 251/100 |
| 3,768,707 | * | 10/1973 | Nigro | 222/402.13 |
| 3,848,778 | | 11/1974 | Meshberg . | |
| 3,894,665 | | 7/1975 | Swenson . | |
| 4,024,988 | * | 5/1977 | Starrett | 222/153 |
| 4,324,351 | | 4/1982 | Meshberg . | |
| 4,542,837 | * | 9/1985 | Rayner | 222/402.11 |
| 4,572,410 | | 2/1986 | Brunet . | |
| 4,620,646 | * | 11/1986 | Crapser | 222/153 |
| 4,773,567 | * | 9/1988 | Stoody | 222/153 |
| 5,027,982 | | 7/1991 | Demarest . | |
| 5,379,924 | * | 1/1995 | Taylor | 222/402.11 |
| 5,649,645 | * | 7/1997 | Demarest et al. | 222/153.07 |

* cited by examiner

*Primary Examiner*—Kevin Shaver
*Assistant Examiner*—Melvin A. Cartagena
(74) *Attorney, Agent, or Firm*—Oblon, Spivak, McClelland, Maier & Neustadt, P.C.

(57) ABSTRACT

A dispensing head and a dispenser equipped with this head for dispensing a liquid product. The dispensing head including a band having an open end fixed to a reservoir which contains the product and is equipped with a dispensing valve, and a push-button intended to control the opening of the valve. The push-button having an actuating surface and a dispensing orifice in communication with the valve. A device is provided for positioning the push-button with respect to the band and for selectively positioning the push-button in an actuating position which allows product to be dispensed, or in a locked position to prevent the valve from being actuated. The push button and the band are configured in such a way that the push-button can be mounted and removed only through the open end of the band.

32 Claims, 6 Drawing Sheets

LOCKABLE DISPENSING HEAD AND DISPENSER EQUIPPED THEREWITH

BACKGROUND OF THE INVENTION

1. Field of the Invention

The invention relates to a head for dispensing a product, for example a liquid product, in the form of a jet or spray, which selectively allows the dispensing of this product to be permitted or prevented. The invention also relates to a dispenser fitted with this dispensing head.

2. Discussion of the Background

In general, such a dispensing head comprises a band which is fixed to a reservoir containing the product that is to be dispensed, and is equipped with a push-button mounted to move inside the said band. Actuation of this push-button allows product to be dispensed, under the action of a propellent means, through an outlet orifice with which the push-button is provided. Conventionally, this push-button also comprises a connection means for placing the push-button in communication with the valve and controlling the opening of the valve, and for connecting the valve to the outlet orifice. The retaining band is intended to guide the push-button when it is actuated. Most usually, the connecting means consists of a peg that is integral with the push-button and capable of collaborating with a valve stem, when the valve has an emerging stem.

More specifically, the invention is aimed at a dispensing head which is protected against accidental loss of the push-button.

In general a means of protection, such as a cap is provided in order to prevent any accidental actuation of the push-button.

A dispenser of this kind can be used in various fields of application and can serve to dispense cosmetic products (hairspray, deodorant, hair mousse, body lotion, hair-removal mousse, liquid foundation, sun lotion) or dermopharmaceutical products (insect repellent, analgesic or anti-inflammatory), household products, paints, etc., and the products can be dispensed in the form of a liquid, gel, spray, mousse or foam.

A dispenser of this kind is described in U.S. Pat. No. 5,388,730. This document describes a dispenser comprising a push-button equipped with a dispensing orifice and a fixing band, this dispenser being equipped with a system for selectively positioning the push-button with respect to the band in a first position in which the push-button can be activated or in a second position which prevents any axial movement of the push-button. The fact that the push-button can be inactivated makes it possible to dispense with the use of a preventive protective cap.

A system for selectively locking the push-button, similar to the one just mentioned, is also described in U.S. Pat. No. 4,324,351 and U.S. Pat. No. 3,848,778.

All the embodiments described in the three aforementioned documents have the drawback that the push-button is mounted from the upper side of the band, after the band has been positioned on the reservoir. As a result of this, the push-buttons of this quoted prior art do not have any means to prevent their accidental detachment from the reservoir associated with the dispenser. Thus, accidental loss of the push-button is not prevented.

What is more, each of the aforementioned dispensers comprises, on the part of the band that is accessible to the user, unattractive recesses designed to co-operate with a radial extension of the push-button, this too being unattractive. Because of this arrangement there is a risk that, when manipulating the push-button, that the user's fingers might become caught between the recessed part of the band and the extension of the push-button. This is as likely to occur when angularly manipulating the locking/actuating system as it is when axially actuating the valve.

Furthermore, the dispenser according to U.S. Pat. No. 3,848,778 requires the user to use both hands to position the push-button in the actuating position, this being a maneuver which is undesirable from an ergonomic viewpoint.

SUMMARY OF THE INVENTION

The object of the present invention is, above all, to improve the ease with which the aforementioned dispensers can be assembled and to allow reliable and ergonomic operation of a dispensing head of this kind.

It is a first object of the invention to provide a dispensing head whose push-button cannot be removed and cannot therefore be lost.

It is another object of the present invention to provide a dispenser which can be marketed without the need to be fitted with a protective cap. This dispenser must, for example, exhibit no risk of accidental loss of the push-button and, above all, carry no risk of inadvertent triggering of the dispensing of product during transport. Specifically, in this case, it is possible to store and to transport such a dispenser without having to resort to special packaging intended to prevent inadvertent actuation of the push-button, something which is advantageous from the economic standpoint.

It is another object of the invention that the dispensing head is able to be preassembled so that it can be mounted on the valve with which the product reservoir is equipped in a single-stage assembly.

A further object of the invention is to provide a dispensing head which can be positioned selectively in an actuating position which allows product to be dispensed, or in a locked position preventing any actuation of the dispensing valve.

It is another object of the invention to provide a dispensing head comprising positioning means for selectively positioning the push-button in the actuating position or in the locked position, and which positioning means can be actuated with just one hand, particularly the hand in which the dispenser is being held.

Yet another object of the invention consists in supplying a dispensing head capable of operating either with a valve that has to be depressed or with a valve that has to be tilted sideways.

It is another object of the invention to provide a dispensing head which allows the push-button to be actuated over a broad actuating area.

Another object of the invention consists in providing a dispensing head which allows the dispensing orifice to be hidden so as to have a way of showing the user whether the push-button is in the actuating position or in the locked position. Furthermore, by hiding the dispensing orifice the risk of the orifice becoming blocked between two periods of use is reduced.

Accordingly, the present invention relates to a head for dispensing a product, for example a liquid product, comprising:

- a band, having an open end fixed to a reservoir which contains the said product and is equipped with a dispensing valve,
- a push-button in communication with the said valve and intended to control the opening of the said valve, the said push-button comprising an actuating surface and a dispensing orifice and, means for positioning the push-button with respect to the band, these positioning means being capable of selectively positioning the push-button in an actuating position which allows product to be dispensed, or in a locked position to prevent the valve from being actuated.

A first example of the invention comprises such a head characterized in that the push-button and the band are configured in such a way that the push-button can be mounted and removed only through the said open end of the band. Advantageously, the band is mounted non-removably on the product reservoir.

The band and the push-button are separate components. However, it is possible for them to be joined together prior to assembly, for example by bridges of material that can be broken at the time of mounting on the said reservoir.

The fact that the push-button is fitted via the open end of the band makes it possible to dispense with the use of a protective cap. This is because a protective cap is generally supplied with this kind of device in order, for example, to prevent the push-button from accidentally detaching, particularly during transport, and thereafter being lost. It also serves to prevent inadvertent triggering of the dispensing valve. Thus, by virtue of the possibility of being able to lock the push-button axially, it is therefore no longer necessary to use such a protective cap with a view to preventing accidental actuation of the dispenser, for example during transport.

The fact that the push-button is non-removable is yet another safety feature for preventing the push-button from being swallowed by a young child which can happen for example in the case of the small-sized push-buttons frequently used on the market.

In addition, the dispensing head at which the invention is aimed may constitute a safety feature to guard against any unauthorized use by children.

Advantageously, part of the band may be arranged in such a way that in the locked position the said dispensing orifice is hidden. Through this arrangement, the user is immediately able to see whether the dispensing head is in an actuating position or in a locked position.

According to a preferred embodiment, means are provided for allowing the push-button when in the actuating position to be articulated with respect to the band about an axis approximately perpendicular to a longitudinal axis of the push-button. Through this arrangement, the dispensing head is able to operate with a sideways tilting valve, whose axis of articulation is also approximately perpendicular to the axis passing through the product outlet orifice. It will, however, be noted that the configuration of this articulation is such that it also allows actuation of a valve of the kind that has to be depressed.

As a preference, anchoring means are provided to make it easier for the push-button to be tilted about the said axis of articulation, each anchoring element borne by the push-button collaborating with a complementary anchoring element located on the interior wall of the band.

These anchoring may for example comprise two tabs secured to the interior wall of the band, extending radially inwards and capable of becoming positioned, in the actuating position, in a corresponding recess made in a free edge of the push-button, and of coming into abutment against the said free edge in the locked position. Of course, the reverse arrangement could also be envisaged.

In an attractive feature of the invention, the movement from the actuating position to the locked position may be achieved by rotating the push-button with respect to the band about the axis of the push-button. This movement from one position to the other is performed by the user using the said positioning means which are formed, for example, of a lug arranged on the push-button, particularly on the actuating surface. Advantageously, this lug extends over at least a peripheral portion of the actuating surface, preferably near the dispensing orifice.

In this embodiment, in the actuating position this dispensing orifice lies facing a slot made in a lateral wall of the band. In the locked position the said orifice is positioned behind the lateral wall of the band, by virtue of an angular positioning which is offset with respect to the position it has in the actuating mode. Thus, when the user sees the outlet orifice appear at the centre of the said slot, he knows that the push-button is in the actuating position. In other words, when the dispensing orifice is not visible, the push-button is in the locked position. Furthermore, in this locked position, the dispensing orifice is protected from dust.

In another attractive feature of the invention, first elastic return means may be provided for generating, when the push-button is actuated, a return force opposed to the direction of the pressing force exerted by the user on the actuating surface, the said first elastic return means being separate from second means of returning the said valve. This arrangement makes it possible to obtain particularly flexible operation, when dispensing product. It also makes it possible not to damage the dispensing valve and, as appropriate, for example the valve stem, and not to adversely affect the elastic properties of the second valve return means.

According to a first possibility, the first elastic return means comprise a tab capable of coming into elastic contact with an interior wall of the band upon actuation of the valve, the said tab being capable of pivoting about an axis perpendicular to the longitudinal axis of the push-button.

According to a second possibility, the first elastic return means comprise at least two tabs capable of coming into elastic contact against the interior wall of the band upon actuation of the valve, the said tabs being capable of pivoting about an axis approximately parallel to the longitudinal axis of the push-button. Of course, the two possibilities of arranging the lug or lugs may be combined.

Regardless as to whether the or each lug is arranged according to the first or according to the second possibility, it is advantageously in tangential contact with the said interior wall of the band.

The push-button comprises a product-conveying duct, connecting the valve to the dispensing orifice, and preferably exhibiting a portion perpendicular to the longitudinal axis of the push-button. This portion exhibits, near the dispensing orifice, an area of reduced cross section which can be placed in a guide means borne by the band. It is thus possible to guide the movement, for example the angular movement, of the push-button between the locked position and the actuating position. The guide means may also constitute a means for axially holding the push-button in the band.

This guide may for example consist of a wall portion concentric with the exterior wall of the band and exhibit an opening which is shaped in such a way as to allow the said area of reduced cross section to engage with the guide means. The guide means allows the push-button to be positioned in an indexed manner with respect to the band, in at least one actuating position and at least one locked position. In this embodiment the position in actuating mode is situated between two positions in locked mode.

As another feature of the invention, the push-button may comprise locking means capable of collaborating with stop means borne by the band, the locking means and the stop means being arranged in such a way that in the locked position these means collaborate with one another and in the actuating position they are inoperative. Advantageously, the locking means and the stop means are arranged inside the dispensing head and are therefore not visible from the outside.

A second aspect of the present invention also provides a dispenser for dispensing a liquid product, comprising:

a reservoir containing the product and a propellant, and equipped with a dispensing valve and fitted with a dispensing head according to the first aspect.

The dispensing head of the invention is designed so that the valve used can be, with equal preference, either a valve of the type that has to be depressed or a valve of the type that has to be tilted sideways. This valve may be a valve of the male type comprising an emerging operating stem communicating with the dispensing orifice via a product-conveying duct in the push-button. It is also possible to use a female valve of the stemless type, in which case the stem is secured to the push-button and in communication with this valve.

The configuration of the push-button and of the band according to the invention makes it possible to produce a subassembly ready to be mounted directly on the product reservoir fitted with the dispensing valve. From an industrial point of view, an embodiment of this kind allows for easy assembly, requiring only low costs for mounting the pre-assembled dispensing head on the reservoir.

BRIEF DESCRIPTION OF THE DRAWINGS

Other features and advantages of the invention will become clear during the following detailed description of one embodiment, given by way of purely illustrative and non-limiting example with reference to the appended drawings. In these drawings.

DETAILED DESCRIPTION OF THE PREFERRED EMBODIMENTS

Figure 1:
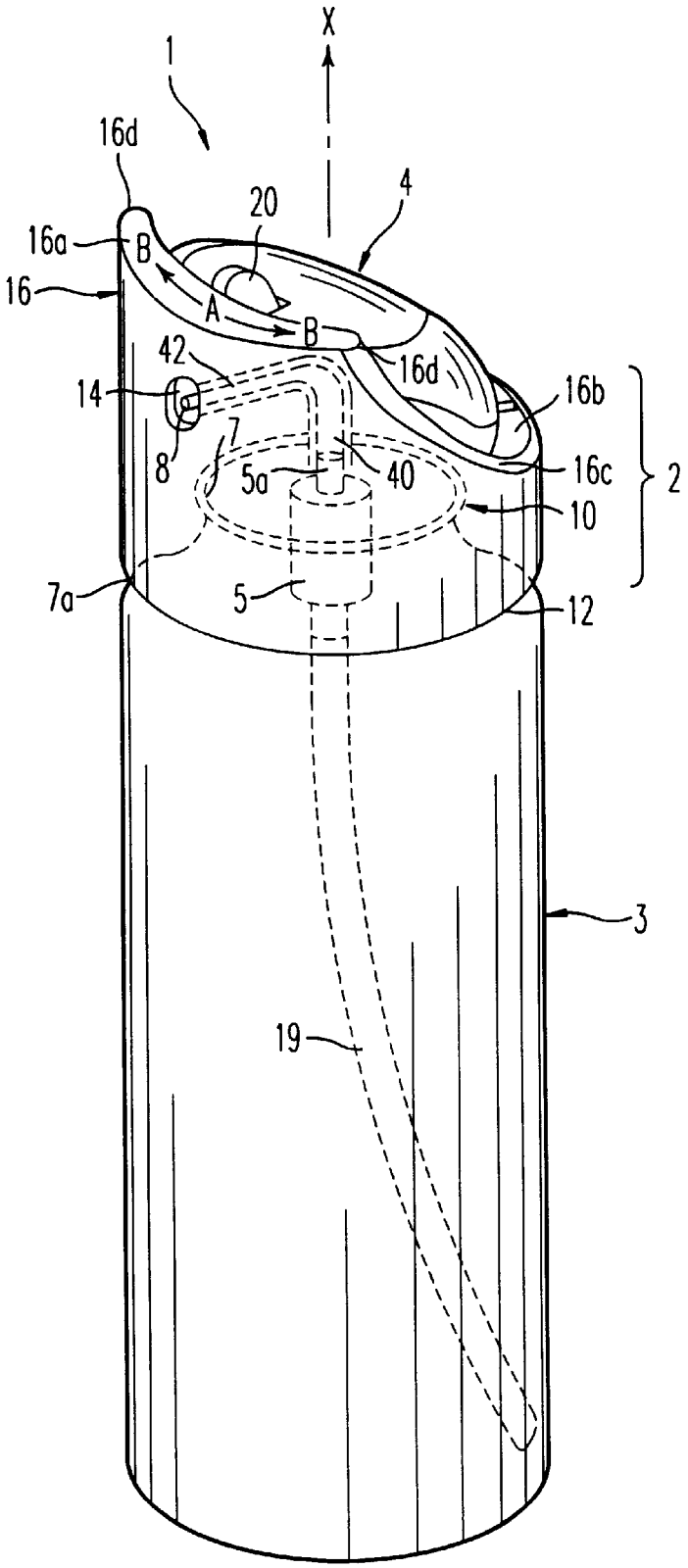
FIG. 1 is a perspective view of a dispenser according to the invention.

Referring to the appended Figures there can be seen, particularly in FIG. 1, a liquid-product dispenser denoted in its entirety by the reference 1.

The dispenser 1 comprises a reservoir 3 in which a product to be dispensed, particularly a liquid product, is packaged. The dispenser 1 has a longitudinal axis X. The reservoir 3 is of cylindrical overall shape and is pressurized by a propellent gas. The reservoir 3 contains, for example, a cosmetic or dermo-pharmaceutical liquid product that is to be dispensed in the form of a single jet, spray, mousse or foam. If appropriate, it is possible to use a reservoir fitted with a bag of product connected to the valve, or to use a reservoir equipped with a piston, acted upon by a propulsion means such as a propellent gas or by a spring, respectively. The reservoir 3 is closed by a valve-holder cup 7 in which a dispensing valve 5 is crimped. The reservoir 3 at its top near the cup 7 has a peripheral attachment groove 7*a*.

The dispenser 1 further comprises a dispensing head 2 formed by a retaining band 10, generally cylindrical, mounted on the reservoir 3 and fixed to the fixing groove 7*a* of the reservoir 3. Furthermore, it has a push-button 4 mounted so that it can move with respect to the band 10 on an emerging stem 5*a* of the dispensing valve 5. The push-button emerges through a central opening 11 made in the band 10.

Figure 4A:
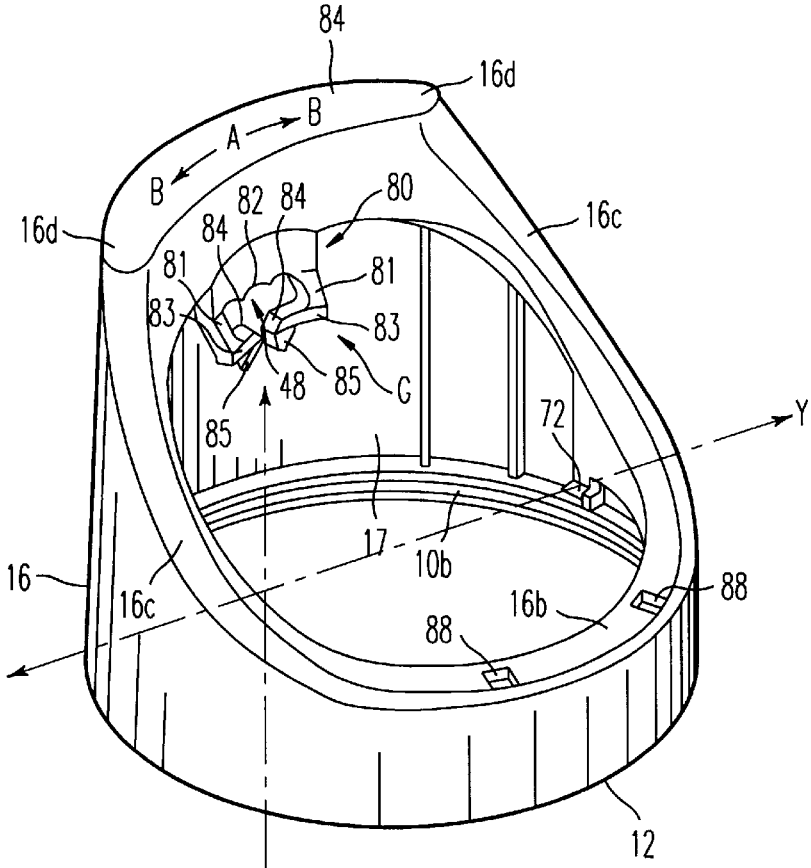
FIGS. 4 to 6 depict various views, shown in exploded perspective, of the dispensing head according to the invention.
Figure 4B:
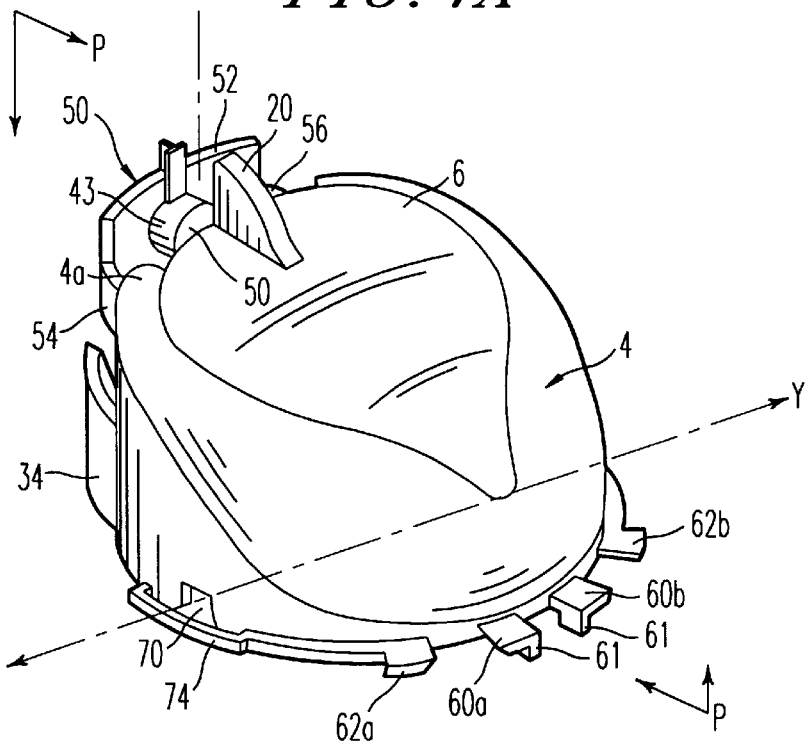

The push-button is in the shape of an asymmetric cap, the top of which forms a dome with an inclined surface 6. This dome 6 constitutes a pressing surface, on which the user exerts pressure in order to cause the dispensing valve 5 to open and thus trigger the dispensing of product. The band 10 has a cylindrical outer skirt 16 equipped on its inside with a snap-fastening bulge 10*b* intended to be fixed, particularly nonremovably, onto the fixing groove 7*a* of the reservoir 3 (FIG. 4).

The band 10 has a first portion 16*a* which is taller than a second portion 16*b* diametrically opposite the first. Two areas 16*c* of changing height connect the short portion 16*b* with the taller portion 16*a*. The portion 16*a* is delimited on its upper surface by two segments 16*d* forming an obtuse angle with the upper surface of the regions 16*c*.

The side wall of the portion 16*a* has a slot 14 intended, in the actuating position, to reveal a dispensing orifice 8, for example a spray nozzle, set back from the slot on the push-button 4. A product-conveying duct 40, 42 connects the dispensing orifice 8 to the valve stem 5*a*. On the opposite side to the stem 5*a*, the valve is connected to a dip tube 19 permanently dipped in the product that is to be dispensed.

The push-button is mounted so that it is able to rotate on the valve stem 5*a* and is therefore capable of pivoting about the axis X. Its freedom to rotate is, however, limited to an angular movement of, for example, between 10° and 60°. As will be seen further on in the description, means are provided for selectively allowing or preventing the dispensing of product, according to the angular position of the push-button.

The push-button 4 further comprises positioning means 20 which are located on the visible surface 6 of the dome. As visible in FIG. 2, the positioning means consist of a protuberance or lug 20 located, when the push-button is in the actuating position, on the periphery thereof near the slot 14 behind the portion 16*a*.

Figure 2:
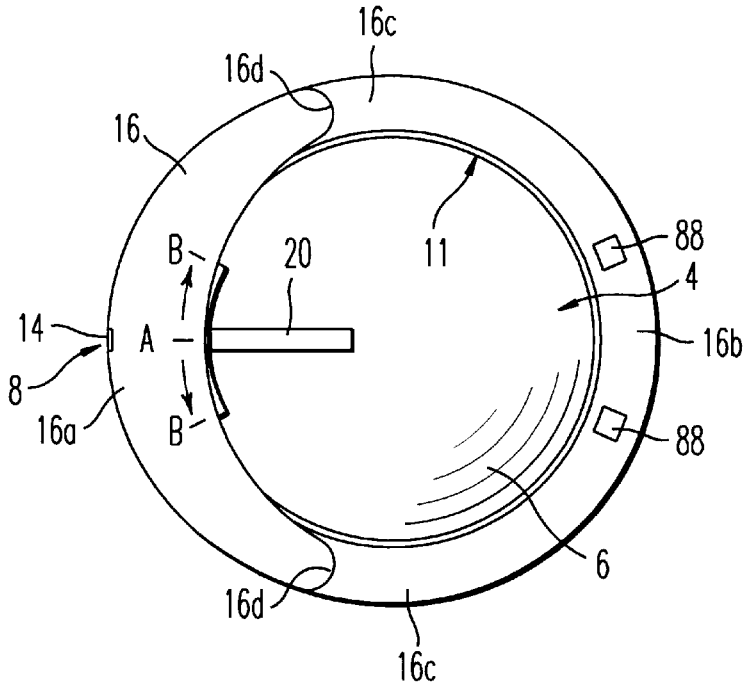
FIG. 2 is a view from above of the dispensing head fitted to the dispenser depicted in FIG. 1, in an actuating position.

Thus, as shown in FIGS. 1 and 2, positioning the protuberance 20 opposite the symbol A allows product to be dispensed. The dispensing orifice 8 is visible behind the slot 14.

Figure 3:
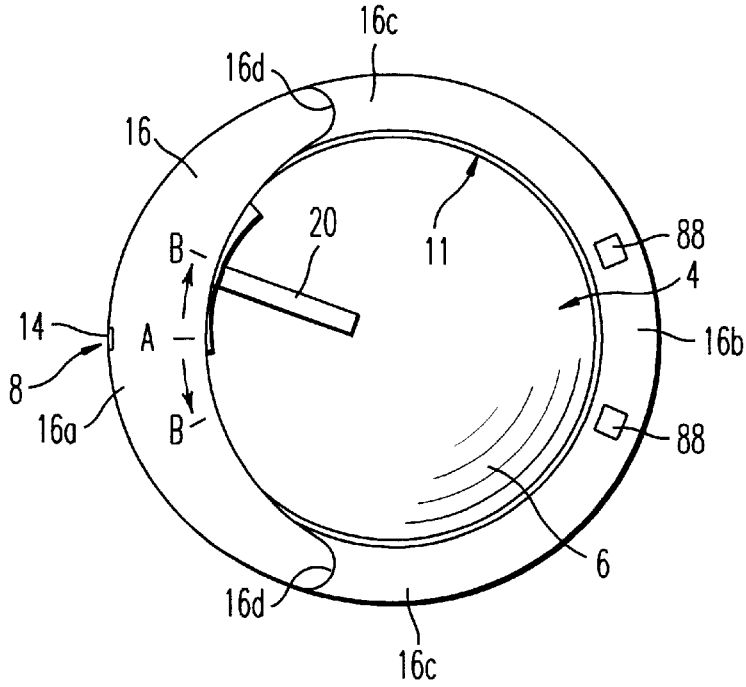
FIG. 3 depicts a view from above of the dispensing head, similar to the view illustrated in FIG. 2, the push-button being in a locked position.

As symbolized in FIG. 3, when this protuberance 20 is facing one of the symbols B, dispensing of product is prevented, the push-button being in a locked position. In this position, the orifice 8 disappears behind the wall 16 of the band 10.

Note that the arrangement of the dispensing head is such that the angular positioning of the push-button and its actuating with a view to dispensing product can be performed using the user's index finger and that this can be done without altering the grip the hand has on the dispenser.

Figure 5A:
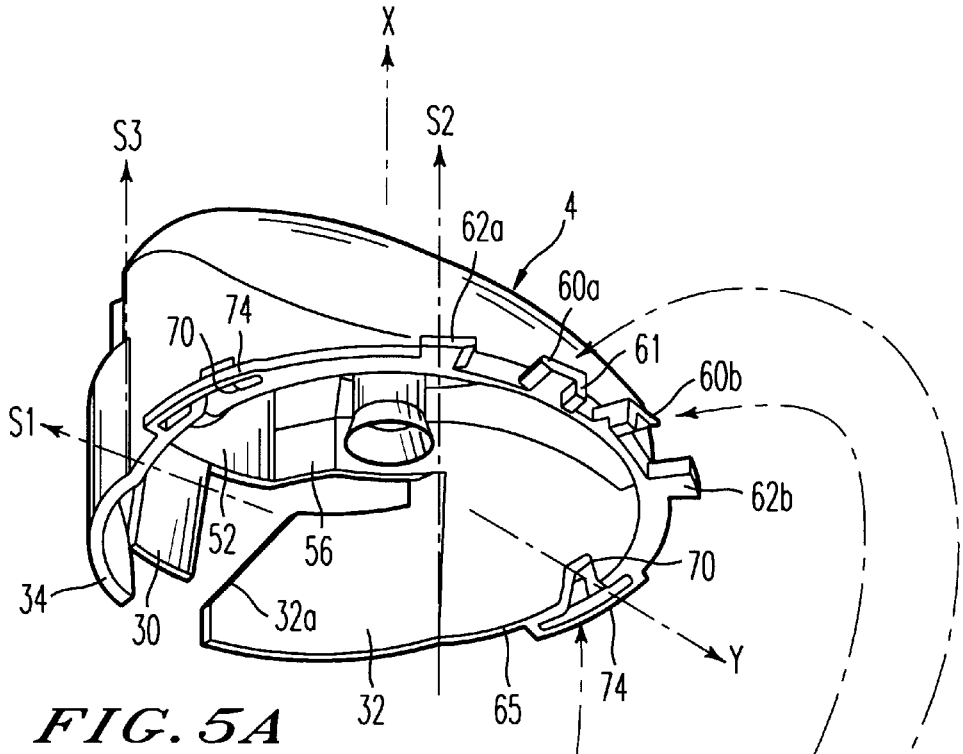
Figure 5B:
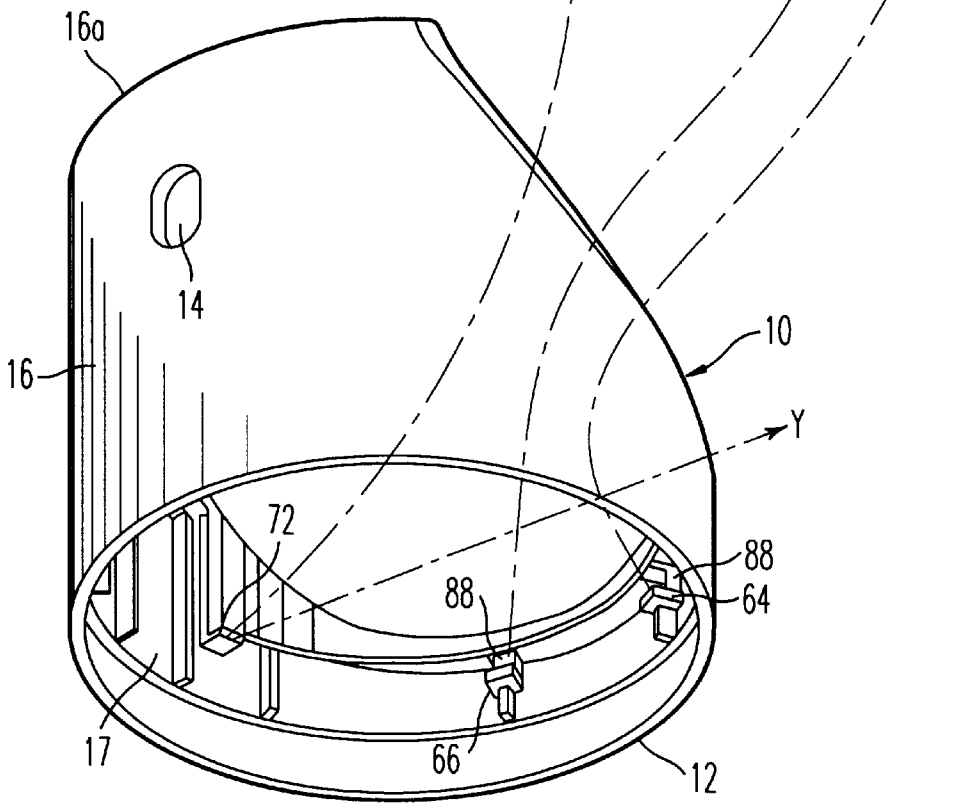
Figure 6A:
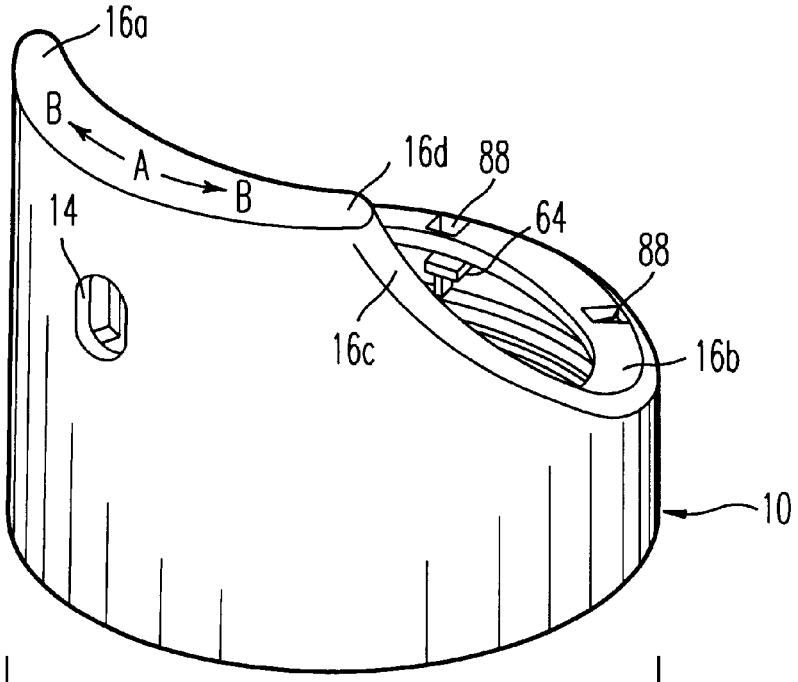
Figure 6B:
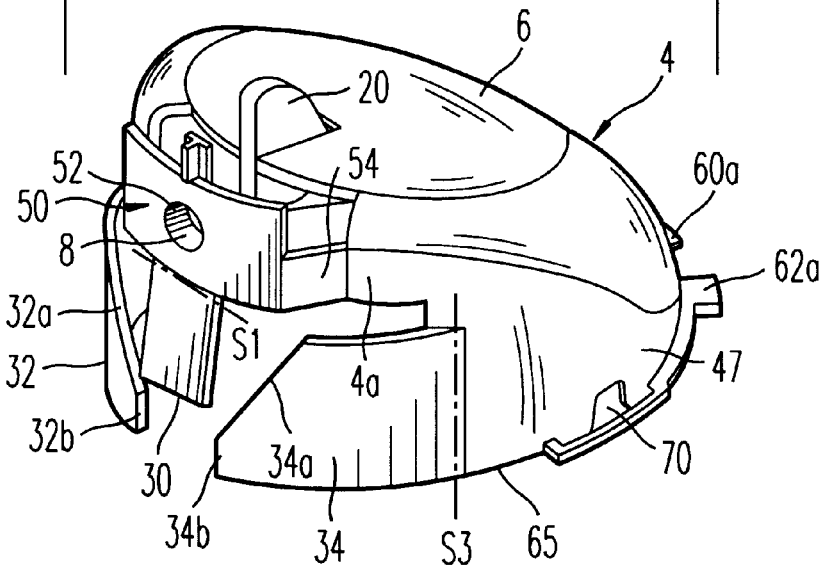

FIGS. 4 to 6 illustrate the details of the arrangement of the band 10 and of the push-button 4 respectively. For reasons of clarity, these two components 4, 10 are depicted dismantled.

In FIG. 4, the push-button 4 is in a position ready to be mounted in the band 10, via the lower open end 12 thereof.

This Figure illustrates the configuration of the pressing surface 6 of the push-button 4, which surface bears the positioning means 20. The push-button 4 has a cylindrical base portion 47, the lower end of which bears the reference 65. A front face 4*a* of the push-button has a frame structure 50 comprising a domed portion 52 attached, at its lateral ends, to the cylindrical portion 47 by two fins 54, 56. The central portion of the domed portion 52 is connected to the dome 6 by the horizontal portion 42 of the conveying duct (see FIGS. 1 and 7).

This portion of the conveying duct 42 has a region 43 of larger diameter, followed by a small-diameter region 44. The large-diameter region 43 defines a housing 45 (FIG. 6) capable of housing a spray nozzle (not depicted). The reduced-diameter region 44 is intended to be mounted in a positioning and guiding member G borne by the band 10 and located opposite the slot 14. It is located a radial distance away that allows the portion 52 to be positioned in the space between the interior wall of the band 17 and the guide member G. This guide member G has an opening 48 delimited by two elastically deformable portions so that the said reduced-diameter region 44 can be introduced into it.

The opening 48 communicates with a slot 80 made in the guide member G above the opening 48. The slot 80 has an elongate shape and is delimited laterally by two portions 81. It is delimited at the top by an upper portion 82 and at the bottom by two lower portions 83 separated from one another by the opening 48. The lower portions 83 each comprise a boss 84 and a guide fin 85. The space formed between the two guide fins 85 exhibits a V-shaped cross section, widening towards the bottom. This V-shaped cross section allows the reduced-diameter region 44 to be introduced into the slot 80 by elastic snap-fastening. Thanks to the bosses 84, the said reduced-diameter region 44 can be arranged selectively in a central position A or in two positions B located one on each side of the position A. The angular movement of the region 44 from one position A or B to the other B or A is eased by virtue of the elastic mounting of the bosses 84.

The base 65 of the push-button has two diametrically opposed recesses 70 located on an axis Y perpendicular to the plane of symmetry P of the push-button. In the actuating position, the recesses 70 accommodate two corresponding tabs 72, secured to the band 10 and extending inwards from the interior wall 17.

Furthermore, at each recess 70, the base 65 has, on its outside, an elastic yoke 74 which allows the push-button to be centred elastically in the band.

In FIGS. 4 to 6 it can be seen that the push-button 4 has two pairs of tabs 60*a*, 60*b*; 62*a*, 62*b*, arranged symmetrically with respect to the plane of symmetry P and extending radially outwards. These tabs constitute locking means capable of coming into contact with corresponding stop means 64, 66 borne by the interior wall 17 of the band.

These stop means consist of two internal radial tabs 64, 66 arranged symmetrically on each side of the said plane of symmetry P (when the push-button is mounted in the band).

The locking means and the stop means are arranged, respectively, in such a way that, when the push-button is in the actuating position A, no interaction between these means can occur. Thus, the push-button can be actuated. During this actuation, the tabs 72 also have a certain axial freedom in the recesses 74.

When the push-button is in one of its locked positions B, the tabs 72 come into abutment against the base 65 of the push-button. At the same time, a tab 60*a*, or 60*b* slips between the stop 66 or 64 and the interior face of the portion 16*b* of the band, thus axially immobilizing the said tab. Likewise, a tab 62*a* or 62*b* slips over the stop 64 or 66, thus locking any axial movement of the said tab. Advantageously, each tab 60*a*, 60*b*, 62*a*, 62*b* laterally has a chamfered or bevelled edge making it easier for these tabs to engage with the stops 64, 66 during positioning of the push-button, from the actuating position A to the locked position B.

To limit the angular travel of the push-button, a fin 61 is provided on each tab 60*a*, 60*b* and is capable of coming into angular abutment against one of the stops 64 or 66 of the band 10.

FIG. 5 also shows a portion 40 of the product-conveying duct which has a flared end 41 intended to take the free end of the valve stem 5*a*.

FIGS. 5 and 6 depict elastic return means which differ from those borne by the valve. For this purpose, a first tongue 30 is fixed to the lower edge of the frame structure 50, extending axially towards the reservoir. With respect to the wall 52, it is inclined slightly outwards, allowing it to come to rest tangentially against the interior wall 17 of the band 10. As the push-button tilts, the tongue 30 pivots about an axis $S_1$ perpendicular to the axis X of the push-button. This tongue makes it possible, once the push-button 4 has tilted, for the push-button to be returned, by elasticity, to its initial position.

Two other tongues 32, 34 forming a portion of the periphery of the push-button 4 and capable of pivoting about two axes $S_2$ and $S_3$ respectively, are arranged symmetrically with respect to the dispensing orifice. The free upper end of each tongue 32, 34 has an inclined portion 32*a*, 34*a*, making the push-button easier to mount in the band. The ends 32*b*, 34*b* of the tongues 32, 34 are arranged to come to bear elastically and tangentially against the interior wall 17 of the band 10. Following lateral actuation of the push-button, these tongues allow this push-button to be returned to its initial position by elasticity.

Because of the presence of the tongues 30, 32, 34, when the push-button is actuated, the operation of the dispensing head is accurate and flexible regardless of the type of valve used. In particular, having the push-button "floating" inside the band, allows the dispenser to be actuated by pressing on any point of the dome 6 and makes the dispenser ergonomic to use.

Furthermore, the portion 16*b* of the band has two rectangular openings 88 which serve as means of releasing the stop means 64, 66 from the mould.

The interior wall 17 of the band further comprises a certain number of stiffening ribs, a detailed description of which will not be given.

Figure 7:
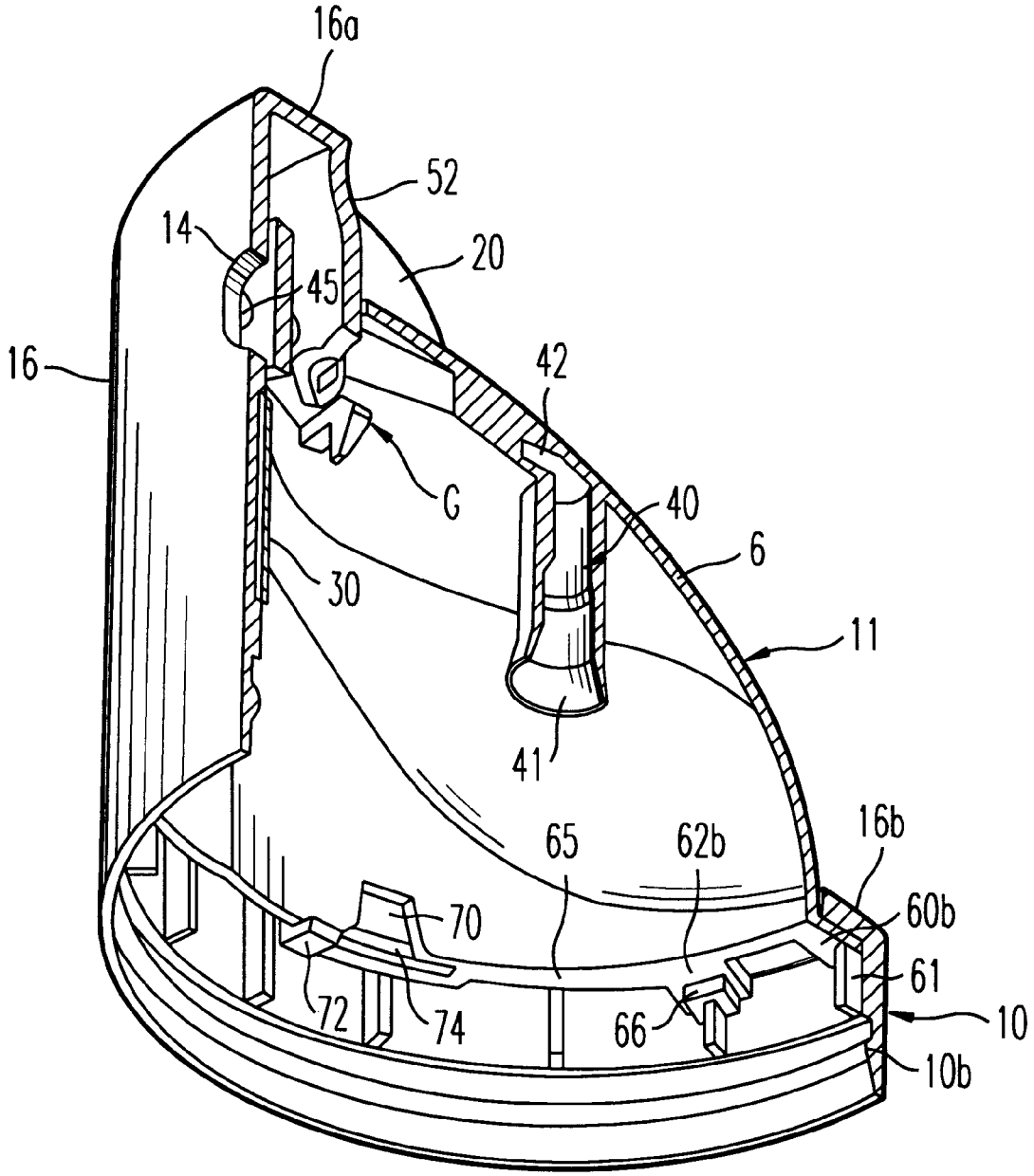
FIG. 7 depicts a view in axial section, shown in perspective, of the dispensing head of the invention, in the assembled position.

FIG. 7 shows a view in axial section of the push-button 4 assembled with the band 10 in the locked position B. In this position, the push-button is secured to the band, and the dispensing head 2 thus formed can be mounted on the reservoir 3.

To assemble the push-button 4 into the band 10, the push-button is introduced axially into the band 10 through the open base 12 so as to place the guide fins 85 in engagement in the reduced-diameter region 44 of the push-button. By pushing axially, having elastically parted these fins, the said reduced-diameter region 44 passes through the opening 48 and comes into abutment against the upper portion of the slot 80 and becomes lodged at the centre thereof, in the position A. Through this operation, the tabs 60*a*, 60*b*, 62*a*, 62*b* of the push-button come to rest against the lower face of the portion 16*b* of the band. The push-button 4 is then pivoted about the axis X with respect to the band 10. At the end of this rotation, one of the fins 61 comes into abutment against the stop 64 (or 66, depending on the direction of rotation).

During the rotation, the reduced-diameter region 44 passes beyond one of the elastic bosses 84 and comes into abutment against one of the lateral portions 81 of the slot 80. Thus, the dispensing head is assembled and finds itself in the locked position B.

The dispensing head is then ready to be mounted on the reservoir 3, already filled with product and propellent gas and fitted with the dispensing valve 5. This assembly operation is advantageously achieved by securely snap-fastening the band onto the reservoir in such a way as to prevent inadvertent removal of the band, and thus of the push-button. The dispenser thus produced can then be marketed with no risk of accidental loss of the push-button or of inadvertent triggering of the dispensing of product during transport.

To dispense the product, the user first of all checks which position the push-button is in. When the dispensing orifice is not visible at the centre of the slot 14 because it is hidden by the lateral wall 16 of the band, the push-button is in the locked position B. In this position, any depressing of the push-button is made impossible because the locking means 65, 60*a*, 60*b*, 62*a*, 62*b* of the push-button are in engagement with the corresponding stop means 72, 64, 66 of the band. The user, taking hold of the dispenser in one hand, places the index finger of this hand on the pressing surface 6. Using the index finger of this same hand, he exerts angular pressure on the positioning means 20 to place the push-button in the actuating position A. By pressing on any point whatsoever of the actuating surface 6, he is able to actuate the valve and dispense some product.

After use, by conferring a rotational movement on the push-button by pressing angularly on the positioning means 20, the dispenser is again brought into the locked position B. From the actuating position, the locked position may be achieved by turning the push-button to the right or to the left, as desired.

It is clearly understood that the embodiment described hereinabove is not by any way limiting and may give rise to any type of desirable modification.

Thus, it is possible to configure the positioning means 20, of relatively small size, in such a way that they are discreet to the eyes of a young child, and thus avoid unauthorized dispensing of product.

It is also possible to mount a spray nozzle in the push-button, the colour of which is a marked contrast to the colour of the band. This allows the user to tell immediately whether the dispenser is in the locked position B or in the actuating position A.

What is claimed is:

1. Head for dispensing a product, comprising:

a body having an open end fixed to a reservoir containing the product and equipped with a dispensing valve;

a push-button intended to control the opening of the valve, the push-button comprising an actuating surface and a dispensing orifice in communication with the valve; and means for positioning the push-button with respect to the body, the positioning means comprising a lug located on the actuating surface and being capable of selectively positioning the push-button in an actuating position which allows product to be dispensed, or in a locked position to prevent the valve from being actuated, characterized in that the push-button and the body are configured in such a way that the push-button can be mounted and removed only through the open end of the body.

2. Dispensing head according to claim 1, characterized in that, in the locked position, the dispensing orifice is hidden.

3. Dispensing head according to claim 2 characterized in that, in the actuating position, the dispensing orifice is located facing a slot made in a lateral wall of the body, the orifice being positioned behind the lateral wall in the locked position.

4. Dispensing head according to claim 1 characterized in that, in the actuating position, the push-button is articulated with respect to the body, about an axis (Y) approximately perpendicular to an axis (X) of the push button.

5. Dispensing head according to claim 1, characterized in that the push-button comprises a product-conveying duct exhibiting a portion perpendicular to the axis (X), this portion exhibiting, near the dispensing orifice, an area of reduced cross section which can be placed in a guide means borne by the band and providing guidance for the movement of the push-button between the locked position and the actuating position.

6. Dispensing head for dispensing a product, comprising:

a body having an open end fixed to a reservoir containing the product and equipped with a dispensing valve;

a push-button intended to control the opening of the valve, the push-button comprising an actuating surface and a dispensing orifice in communication with the valve; and means for positioning the push-button with respect to the body, the positioning means being capable of selectively positioning the push-button in an actuating position which allows product to be dispensed, or in a locked position to prevent the valve from being actuated, wherein the push-button and the body are configured in such a way that the push-button can be mounted and removed only through the open end of the body, wherein, in the actuating position, the push-button is articulated with respect to the body, about an axis (Y) approximately perpendicular to an axis (X) of the push button, and wherein the movement from the actuating position to the locked position is achieved by rotating the push-button about the axis (X) with respect to the body.

7. Dispensing head for dispensing a product, comprising:

a body having an open end fixed to a reservoir containing the product and equipped with a dispensing valve;

a push-button intended to control the opening of the valve, the push-button comprising an actuating surface and a dispensing orifice in communication with the valve;

means for positioning the push-button with respect to the body, the positioning means being capable of selectively positioning the push-button in an actuating position which allows product to be dispensed, or in a locked position to prevent the valve from being actuated, wherein the push-button and the body are configured in such a way that the push-button can be mounted and removed only through the open end of the body; and a first elastic return means for generating a return force opposed to a direction of a pressing force exerted on the actuating surface when the push-button is actuated, the first elastic return means being separate from a second return means of the valve.

8. Dispensing head according to claim 7, characterized in that the first elastic return means comprises at least two tabs capable of coming into elastic contact against an interior wall of the body upon actuation of the valve, the tabs being capable of pivoting about an axis approximately parallel to the axis (X).

9. Dispensing head according to claim 8, characterized in that the tabs are in tangential contact with the interior wall of the body.

10. Dispensing head for dispensing a product, comprising:

a body having an open end fixed to a reservoir containing the product and equipped with a dispensing valve;

a push-button intended to control the opening of the valve, the push-button comprising an actuating surface and a dispensing orifice in communication with the valve; and means for positioning the push-button with respect to the body, the positioning means being capable of selectively positioning the push-button in an actuating position which allows product to be dispensed, or in a locked position to prevent the valve from being actuated, wherein the push-button and the body are configured in such a way that the push-button can be mounted and removed only through the open end of the body; and a tab capable of coming into elastic contact against an interior wall of the body upon actuation of the valve, the tab being capable of pivoting about an axis perpendicular to the axis (X).

11. Dispensing head according to claim 10, characterized in that the first elastic return means comprises at least two tabs capable of coming into elastic contact against an interior wall of the body upon actuation of the valve, the tabs being capable of pivoting about an axis approximately parallel to the axis (X).

12. Dispensing head according to claim 10, characterized in that the tab is in tangential contact with the interior wall of the body.

13. Dispensing head for dispensing a product, comprising:

a body having an open end fixed to a reservoir containing the product and equipped with a dispensing valve;

a push-button intended to control the opening of the valve, the push-button comprising an actuating surface and a dispensing orifice in communication with the valve; and means for positioning the push-button with respect to the body, the positioning means being capable of selectively positioning the push-button in an actuating position which allows product to be dispensed, or in a locked position to prevent the valve from being actuated, wherein the push-button and the body are configured in such a way that the push-button can be mounted and removed only through the open end of the body;

wherein the push-button comprises a product-conveying duct exhibiting a portion perpendicular to the axis (X), this portion exhibiting, near the dispensing orifice, an area of reduced cross section which can be placed in a guide means borne by the body and providing guidance for the movement of the push-button between the locked position and the actuating position;

wherein the guide means comprises a wall portion concentric with the exterior wall of the body and exhibiting an opening which is shaped in such a way as to allow the area of reduced cross section to engage with the guide means, the guide means allowing the push-button to be positioned in an indexed manner with respect to the body in at least one actuating position and at least one locked position.

14. Dispensing head for dispensing a product, comprising:

a body having an open end fixed to a reservoir containing the product and equipped with a dispensing valve;

a push-button intended to control the opening of the valve, the push-button comprising an actuating surface and a dispensing orifice in communication with the valve; and means for positioning the push-button with respect to the body, the positioning means being capable of selectively positioning the push-button in an actuating position which allows product to be dispensed, or in a locked position to prevent the valve from being actuated, wherein the push-button and the body are configured in such a way that the push-button can be mounted and removed only through the open end of the body;

wherein the push-button comprises locking means capable of co-operating with stop means borne by the body, the locking means and the stop means being arranged in such a way that these means co-operate with one another in the locked position and are inoperative in the actuating position.

15. Dispensing head for dispensing a product, comprising:

a body having an open end fixed to a reservoir containing the product and equipped with a dispensing valve;

a push-button intended to control the opening of the valve, the push-button comprising an actuating surface and a dispensing orifice in communication with the valve; and means for positioning the push-button with respect to the body, the positioning means being capable of selectively positioning the push-button in an actuating position which allows product to be dispensed, or in a locked position to prevent the valve from being actuated, wherein the push-button and the body are configured in such a way that the push-button can be mounted and removed only through the open end of the body;

wherein, in the locked position, the dispensing orifice is hidden, and wherein in the actuating position, the dispensing orifice is located facing a slot made in a lateral wall of the body, the orifice being positioned behind the lateral wall in the locked position; and anchoring means to make it easier for the push-button to be tilted about the axis (Y), comprising an anchoring element borne by the push-button co-operating with a complementary anchoring element located on the interior wall of the body.

16. Dispensing head according to claim 15, characterized in that the anchoring means comprise two tabs which are secured to the interior wall of the body, which extend radially inwards, and which are capable of becoming lodged in a corresponding recess made in a free edge of the push-button in the actuating position and of coming into abutment against the free edge in the locked position.

17. A head for dispensing a product, comprising:

a body having an open end mounted to a reservoir containing the product and equipped with a dispensing valve;

a push-button mounted to control the opening of the valve, the push-button having an actuating surface and a dispensing orifice in communication with the valve, the push-button being mounted for selective positioning in an actuating position in which the push button allows product to be dispensed, and in a locked position in which the push button prevents the valve from being actuated, wherein the push-button and the body are configured such that the push-button can be mounted and removed through the open end of the body; and a lug located on the actuating surface at such a location as to position the push-button with respect to the body.

18. Dispensing head according to claim 17, wherein, in the locked position, the dispensing orifice is hidden.

19. Dispensing head according to claim 18 wherein, in the actuating position, the dispensing orifice faces a slot made in a lateral wall of the body, the orifice being obstructed by the lateral wall when the push button is in the locked,position.

20. Dispensing head according to claim 17 wherein, in the actuating position, the push-button is articulated with respect to the body, about an axis approximately perpendicular to an axis of the push button.

21. Dispensing head according to claim 17, wherein the push-button further comprises a lock arranged and configured to cooperate with a stop when the push button is in the locked position.

22. A head for dispensing a product, comprising:

a body having an open end mounted to a reservoir containing the product and equipped with a dispensing valve;

a push-button mounted to control the opening of the valve, the push-button having an actuating surface and a dispensing orifice in communication with the valve, the push-button being mounted for selective positioning in an actuating position in which the push button allows product to be dispensed, and in a locked position in which the push button prevents the valve from being actuated, wherein the push-button and the body are configured such that the push-button can be mounted and removed through the open end of the body, wherein, in the actuating position, the push-button is articulated with respect to the body, about an axis approximately perpendicular to an axis of the push button, wherein movement of the push button from the actuating position to the locked position occurs by rotating the push button about the axis of the push button.

23. A head for dispensing a product, comprising:

a body having an open end mounted to a reservoir containing the product and equipped with a dispensing valve;

a push-button mounted to control the opening of the valve, the push-button having an actuating surface and a dispensing orifice in communication with the valve, the push-button being mounted for selective positioning in an actuating position in which the push button allows product to be dispensed, and in a locked position in which the push button prevents the valve from being actuated, wherein the push-button and the body are configured such that the push-button can be mounted and removed through the open end of the body; and a first elastic return part for generating a return force opposed to a direction of a pressing force exerted on the actuating surface when the push-button is actuated, and a second return part of the valve, the first elastic return part being separate from the second return part of the valve.

24. A head for dispensing a product, comprising:

a body having an open end mounted to a reservoir containing the product and equipped with a dispensing valve;

a push-button mounted to control the opening of the valve, the push-button having an actuating surface and a dispensing orifice in communication with the valve, the push-button being mounted for selective positioning in an actuating position in which the push button allows product to be dispensed, and in a locked position in which the push button prevents the valve from being actuated, wherein the push-button and the body are configured such that the push-button can be mounted and removed through the open end of the body; and at least one tab positioned to come into elastic contact against an interior wall of the body upon actuation of the valve, the tab being mounted to pivot about an axis perpendicular to the axis of the push button.

25. Dispensing head according to claim 24, wherein the at least one tab comprises at least two tabs positioned to come into elastic contact against an interior wall of the body upon actuation of the valve, the tabs being mounted to pivot about the axis approximately parallel to the axis of the push button.

26. Dispensing head according to claim 24, wherein the tab is in tangential contact with the interior wall of the body.

27. A head for dispensing a product, comprising:

a body having an open end mounted to a reservoir containing the product and equipped with a dispensing valve;

a push-button mounted to control the opening of the valve, the push-button having an actuating surface and a dispensing orifice in communication with the valve, the push-button being mounted for selective positioning in an actuating position in which the push button allows product to be dispensed, and in a locked position in which the push button prevents the valve from being actuated, wherein the push-button and the body are configured such that the push-button can be mounted and removed through the open end of the body; and a first elastic return means for generating a return force opposed to a direction of a pressing force exerted on the actuating surface when the push-button is actuated, and a second return means of the valve, the first elastic return means being separate from a second return means of the valve, wherein the first elastic return means comprises at least two tabs positioned to come into elastic contact against an interior wall of the body upon actuation of the valve, the tabs being mounted to pivot about an axis approximately parallel to the axis of the push button.

28. Dispensing head according to claim 27, wherein the tabs are in tangential contact with the interior wall of the body.

29. A head for dispensing a product, comprising:

a body having an open end mounted to a reservoir containing the product and equipped with a dispensing valve; and a push-button mounted to control the opening of the valve, the push-button having an actuating surface and a dispensing orifice in communication with the valve, the push-button being mounted for selective positioning in an actuating position in which the push button allows product to be dispensed, and in a locked position in which the push button prevents the valve from being actuated, wherein the push-button and the body are configured such that the push-button can be mounted and removed through the open end of the body, wherein the body includes a guide, and wherein the push-button comprises a product-conveying duct exhibiting a portion perpendicular to an axis of the push button, said portion exhibiting, near the dispensing orifice, an area of reduced cross section which can be placed in the guide to guide movement of the push-button between the locked position and the actuating position.

30. Dispensing head according to claim 24, wherein the guide means comprises a wall portion concentric with the exterior wall of the band and exhibiting an opening which is shaped to allow the area of reduced cross section to engage with the guide means, the guide means allowing the push-button to be positioned in at least the actuating position and the locked position in an indexed manner.

31. A head for dispensing a product, comprising:

a body having an open end mounted to a reservoir containing the product and equipped with a dispensing valve;

a push-button mounted to control the opening of the valve, the push-button having an actuating surface and a dispensing orifice in communication with the valve, the push-button being mounted for selective positioning in an actuating position in which the push button allows product to be dispensed, and in a locked position in which the push button prevents the valve from being actuated, wherein the push-button and the body are configured such that the push-button can be mounted and removed through the open end of the body;

wherein, in the actuating position, the dispensing orifice faces a slot made in a lateral wall of the body, the orifice being obstructed by the lateral wall when the push button is in the locked position, and wherein, in the actuating position, the push-button is articulated with respect to the body, about an axis approximately perpendicular to an axis of the push button; and anchoring elements borne by the push-button and each cooperating with a complementary anchoring element located on the interior wall of the body to aid in tilting the push-button about the axis perpendicular to the axis of the axis of the push button.

32. Dispensing head according to claim 31, wherein the anchoring elements comprise tabs which are secured to the interior wall of the body, which tabs extend radially inwards, and which tabs are configured to be capable of becoming lodged in a corresponding recess made in a free edge of the push-button in the actuating position, and of coming into abutment against the free edge in the locked position.

* * * * *

UNITED STATES PATENT AND TRADEMARK OFFICE

CERTIFICATE OF CORRECTION

PATENT NO. : 6,302,302 B1
DATED : October 16, 2001
INVENTOR(S) : Nicolas Albisetti It is certified that error appears in the above-identified patent and that said Letters Patent is hereby corrected as shown below:

Column 13,
Line 18, delete the ",".

Signed and Sealed this

Second Day of April, 2002

*Attest:*

*Attesting Officer*

JAMES E. ROGAN
*Director of the United States Patent and Trademark Office*